US006364998B1

(12) United States Patent
Sabourin

(10) Patent No.: US 6,364,998 B1
(45) **Date of Patent: *Apr. 2, 2002**

(54) METHOD OF HIGH PRESSURE HIGH-SPEED PRIMARY AND SECONDARY REFINING USING A PREHEATING ABOVE THE GLASS TRANSITION TEMPERATURE

(75) Inventor: Marc J. Sabourin, Huber Heights, OH (US)

(73) Assignee: Andritz Inc., Muncy, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/258,760

(22) Filed: Feb. 26, 1999

Related U.S. Application Data

(63) Continuation-in-part of application No. 08/907,687, filed on Aug. 8, 1997, which is a division of application No. 08/736,366, filed on Oct. 23, 1996, now Pat. No. 5,776,305, which is a continuation-in-part of application No. 08/489,332, filed on Jun. 12, 1995, now abandoned.

(51) Int. Cl.[7] ..... D21B 1/12

(52) U.S. Cl. ..... 162/23; 162/28; 241/28; 241/29

(58) Field of Search ..... 162/23, 9, 28, 162/68, 63; 241/28, 29, 261.3, 297, 259

(56) References Cited

U.S. PATENT DOCUMENTS

| | | | | | |
|---|---|---|---|---|---|
| 4,372,810 | A | * | 2/1983 | Bystedt | 162/23 |
| 5,248,099 | A | * | 9/1993 | Lahner et al. | 241/28 |
| 5,776,305 | A | * | 7/1998 | Sabourin | 162/28 |

FOREIGN PATENT DOCUMENTS

| | | | | |
|---|---|---|---|---|
| WO | 94/16139 | * | 7/1994 | 162/28 |

* cited by examiner

*Primary Examiner*—Steve Alvo
(74) *Attorney, Agent, or Firm*—Alix, Yale & Ristas, LLP

(57) ABSTRACT

The combination of low residence time (R) with high saturation pre-heat temperature/pressure (T) followed by high speed disc refining (S), is utilized in both primary and secondary refining stages. This use of the RTS process in both primary and secondary refining stages, can be accomplished in one embodiment, where the primary refining is performed in a first disc refiner and the secondary refining is performed in a distinct second disc refiner. In a particularly cost-effective second embodiment the primary and secondary refining are performed within a single refining machine having distinct primary and secondary refining zones which are fluidly connected in series.

20 Claims, 9 Drawing Sheets

METHOD OF HIGH PRESSURE HIGH-SPEED PRIMARY AND SECONDARY REFINING USING A PREHEATING ABOVE THE GLASS TRANSITION TEMPERATURE

This is a continuation-in-part of co-pending application Ser. No. 08/907,687 filed Aug. 8, 1997, which is a division of patent application Ser. No. 08/736,366 filed Oct. 23, 1996, now U.S. Pat. No. 5,776,305, which is a continuation-in-part of application 08/489,332, filed Jun. 12, 1995, now abandoned.

BACKGROUND OF THE INVENTION

The present invention relates to high consistency refining of lignocellulosic material, and in particular to refining of wood chips and the like for production of mechanical pulp.

U.S. Pat. No. 5,776,305 discloses a method which achieves significant advances in the trade-off between pulp quality and energy utilization, by preheating the feed chips at a high steam saturation temperature (T) for a short residence time (R), followed by high intensity, high speed disc refining (S). The preheat and refining temperature (T) is above the glass transition temperature of the lignin (i.e., above $T_g$). The process described in the '305 patent can be conveniently referred to as "RTS". The disclosure of U.S. Pat. No. 5,776,305, is hereby incorporated by reference.

SUMMARY OF THE INVENTION

It is an object of the present invention, to further extend the benefits observed with the RTS process described in U.S. Pat. No. 5,776,305.

Such further benefits have indeed been realized in accordance with the present invention, whereby the combination of low residence time (R) with high saturation pre-heat temperature/pressure (T) followed by high speed disc refining (S), is utilized in both primary and secondary refining stages.

This use of the RTS process in both primary and secondary refining stages, can be accomplished in one embodiment, where the primary refining is performed in a first disc refiner and the secondary refining is performed in a distinct second disc refiner. In a particularly cost-effective second embodiment the primary and secondary refining are performed within a single refining machine having distinct primary and secondary refining zones which are fluidly connected in series. For convenience, the invention in any of these embodiments or variations, will be referred to as the $RTS^2$ system or process.

In laboratory tests of the present invention using spruce furnish, latency chest freeness levels were obtained at 200 ml, with refiner total specific energy requirements of only 1348 kwh/ODMT. Relative to conventional TMP pulp, the process according to the present invention can achieve improved strength properties and lower shive content, with more than 400 kwh/ODMT savings in energy requirements.

A further improvement to the $RTS^2$ system and process may be achieved by careful selection of different refiner plate patterns, temperature, effective residence time, and refiner speed in the second refiner. In some circumstances, it may be preferable for the secondary conditions to be somewhat less severe than in the primary, i.e., a pressure in the range of 65–85 psi, residence time in the range of under 30 seconds, and refiner speed of 1800–2600 rpm in the secondary, versus a pressure range of 75–95 psi, residence time of 15 seconds or less, and speed of 2000–2600 rpm in the primary. In the embodiment wherein the primary and secondary refining zones are in a single machine and the disc rotation speeds will likely be identical, it is most preferred that the preheat residence time and temperature in the secondary, be somewhat less than that in the primary. For example, the secondary refining pressure can be up to about one bar lower than the primary refining pressure.

BRIEF DESCRIPTION OF THE DRAWINGS

These and other objects and advantages of the invention will be evident to practitioners in this field from the following description made with reference to the accompanying figures, in which.

DESCRIPTION OF THE PREFERRED EMBODIMENTS

Figure 1:
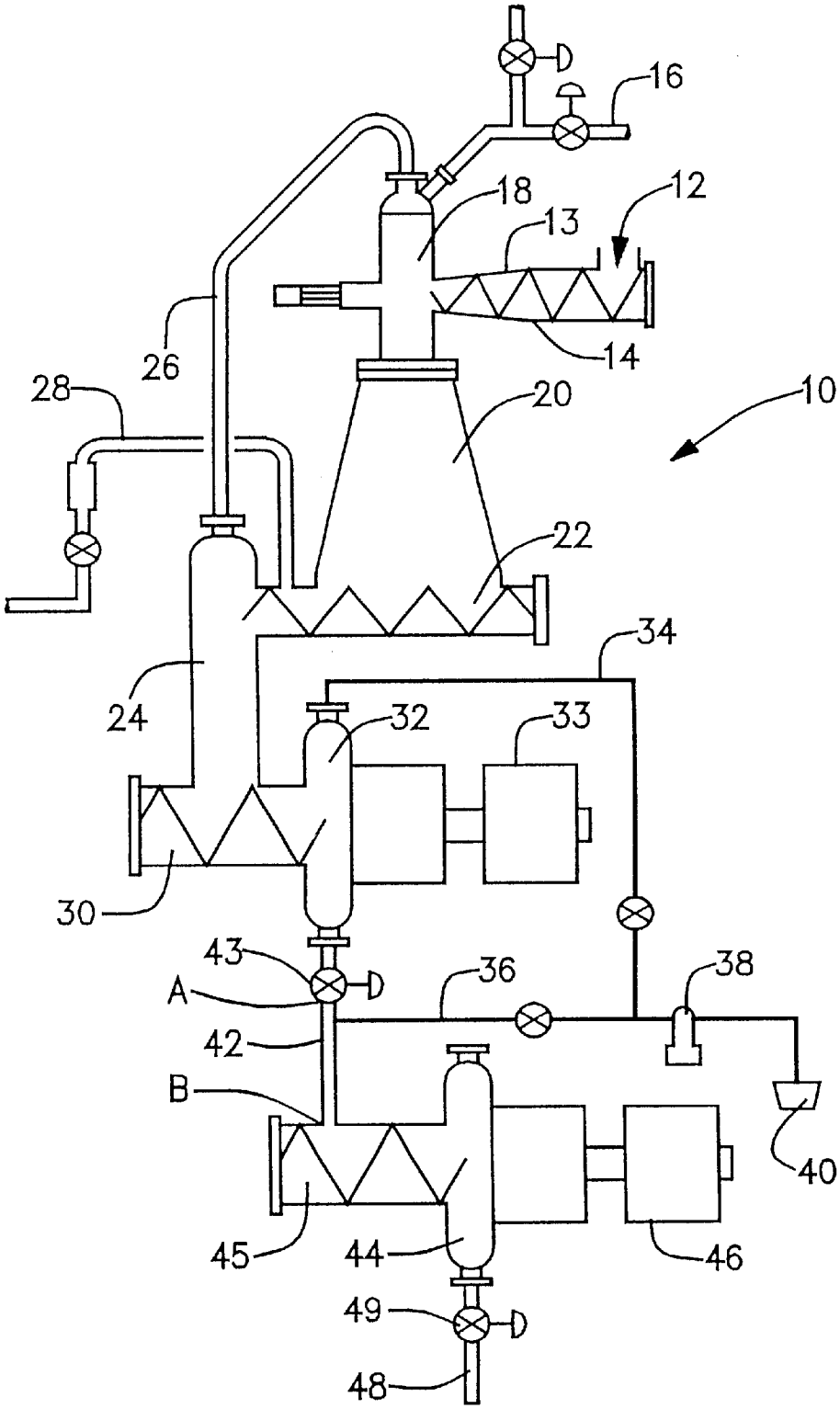
FIG. 1 is a system representation of a first embodiment of the invention, in which the primary and secondary refiners are distinct.

FIG. 1 represents a portion of a pulp refining installation 10 embodying the present invention, in which lignocellulosic material such as wood chips are delivered to a plug screw feeder 12 having a rotating screw 14 associated with a tapered wall 13, whereby the feed material is conveyed for treatment, while at the same time forming a pressure barrier in the form of a plug at the outlet of the plug screw feeder 12. The chip material is deposited through steam separator 18 for gravity feed into a preheat vessel 20 which, at its bottom, has a high pressure variable speed conveying screw 22. Screw 22 deposits the preheated chips through steam separator 24 into the feed mechanism, typically a ribbon screw 30, associated with primary refiner 32. The refiner 32 contains a rotating disc (not shown) which confronts a stationary or counter rotating disc, thereby defining a primary refining zone therebetween. The rotating disc is mounted to a rotor which in turn is driven by motor 33, which preferably also rotates the ribbon feeder 30.

The foregoing may be considered as a coupled system, in that the pressure and temperature is substantially constant between the pressure barrier defined near the exit of plug screw feeder 12, and the high pressure established between the relatively rotating discs in refiner 32. The conditions between the pressure barrier at the exit of plug screw feeder 12, and the discharge of primary refiner 32 through valve 43 into blow line 42, are substantially uniform at a higher than conventional saturation temperature/pressure in the range of 75–95 psi (gauge), corresponding to about 90–110 psi (absolute); 517–655 kPa (gauge); 618–756 kPa (absolute); 320–335° F., and 160–170° C.

The preheat environment of saturated steam has high energy content and the steam can be drawn away via separators 18 and 24, through line 26, for eventual reuse in the plant via line 16. Optionally, chemicals or other fluids may be introduced via line 28, into the feed material during preheating.

Although a conventional steaming vessel 20 is shown in FIG. 1, it would be operated in accordance with the RTS process by maintaining a very low level of chips such that the transit time from the exit of the plug screw feeder 12 to introduction at the ribbon feeder 30, would be determined predominantly by the selected speed of the variable speed transfer screw 22. The preheat residence time (in this embodiment from the exit of plug screw feeder 12 to the ribbon feeder 30), would be less than 30 seconds, preferably no greater than about 15 seconds, and in many instances ideally in the range of 5–10 seconds.

The disc refiner 32 operates at a high speed, preferably above 2000 rpm and at an especially preferred speed of 2300–2600 rpm. Alternatively, a double disc refiner (i.e., having counter-rotating discs or equivalent), would operate above 1500 rpm, at an especially preferred speed of at least 1800 rpm, e.g., 2300 rpm.

In a desirable variation, the steaming vessel is eliminated and the plug screw feeder 12 feeds pressurized transfer screw 22 directly through steam separator 18. In either variation, once the feed material has been elevated to the high temperature, i.e., sufficient to raise the fiber therein above the glass transition temperature $T_g$, preferably by 10–20° C. or more, the material does not experience mechanical compression.

The feed material may, however, be preconditioned before the preheating stage, by compression at elevated temperature and pressure, such as described in co-pending U.S. patent application Ser. No. 907,687, filed Aug. 8, 1997, for "Method of Pretreating Lignocellulose Fiber Containing Material for the Pulp Making Process".

The partially refined pulp is discharged through blow line 42 which, at the discharge of valve 43 following a primary refining pressure of 85 psi, is at a pressure of typically 30 to 60 psi. The partially refined material travels through blow line 42 and is fed directly into a high consistency, secondary disc refiner 44 via feed mechanism such as ribbon screw 45. Disc refiner 44 may be driven by motor 46 of any known configuration.

In accordance with the present invention, the refining process associated with the secondary refiner 44, is also optimized within an R,T,S window. For convenience, $R_1$, $T_1$, $S_1$ will denote the primary conditions and $R_2$, $T_2$, $S_2$ will denote secondary conditions. With respect to the secondary refining, the preheat residence time $R_2$ of the feed material into the secondary refiner 44, can be measured from point A to point B as shown in FIG. 1. Similarly, the temperature $T_2$ above the glass transition temperature of the material, is maintained from point A to point B. It should be appreciated that the steam temperature may be somewhat lower than the temperature at which the chips are preheated in advance of the primary refiner 32. At the secondary refining stage, the feed material is pulp rather than wood chips. The lignin-rich middle lamella is therefore directly exposed to the steam at $T_2$, which should be kept at a lower temperature than $T_1$, to minimize thermal darkening reactions. Therefore, the lower end of the temperature range for $T_2$ can be below that of $T_1$, i.e., $T_2$ in the range of 60–85 psi and $T_1$ in the range 75–95 psi. The residence time interval $R_2$ will typically also be at or below the low end of the range for the primary refining, i.e., in the range of 1–10 seconds, with 2–5 seconds preferred. If the secondary refiner 44 is a single disc refiner, the high speed rotation $S_2$ would be in the same range as that for the primary refiner 32, i.e., 2000–2600 rpm, and if it is a double disc refiner, the range would be 1800–2300 rpm. The fully refined pulp is discharged from the refiner 44 through valve 49 and blow-line 48 for subsequent processing. Bleaching agents or other chemicals can optionally be introduced through lines 34 and 36, after measurement at line 38, from source 40.

In a laboratory test analogous to the system configuration shown in FIG. 1, spruce wood chips were refined in the first stage utilizing a 36 inch pressurized single disc refiner, followed by a second stage in a distinct 36 inch pressurized single disc refiner, for evaluating the $RTS^2$ process configuration as summarized above. In a first test, runs were conducted with the same bidirectional refiner plate pattern (D14B002, available from Durametal Corporation, Muncy, Pa.) operating on the rotor and stator in both the primary and secondary refiners. Table I summarizes the optimal conditions obtained from these runs.

TABLE I

| | PRIMARY | | SECONDARY | | |
|---|---|---|---|---|---|
| | TMP | RTS | TMP | RTS | $RTS^2$ |
| Press. Screw Feed (rpm) | 18 | 18 | 40 | 40 | 40 |
| Dilution (gpm) | 3.0 | 3.0 | 2.0 | 2.0 | 2.0 |
| Pressure (psig) | 40 | 85 | 40 | 40 | 70 |
| Retention (min) | 3.0 | 0.15 | * | * | * |
| Refiner Speed (rpm) | 1800 | 2600 | 1800 | 1800 | 2300/2600 |

The asterisk in Table I indicates that a small setup residence was necessary at the beginning of the runs (15 seconds) to establish a stable level in the vertical steaming tube feeding the secondary refiner feed conveyor. In an actual mill operation, the retention time feeding the secondary refining stage is lower, permitting further improved loadability and higher optical properties following second stage refining i.e., direct blow feed via primary pressurized cyclone in mill operation.

A 70 psi refining pressure was selected for the second refining stage to minimize thermal darkening reactions and to minimize chemical oxygen demand (COD) levels. This pressure is also desirable since it represents a practical range for implementing the invention in the configuration to be described below with respect to FIGS. 2 and 3, by modifying known equipment (i.e., the HXD 64 refiner, previously available from Kvaerner Hymac, Inc., now available from Andritz Inc., Muncy, Pa.).

In another test, the D14B002 plate pattern was used in the rotor and stator of the primary refiner, but a variable pitch refiner plate pattern 36A001 was used in the rotor and stator of the secondary refiner. A similar variable pitch plate is disclosed in co-pending U.S. patent application Ser. No.08/

886,310 now U.S. Pat. No. 5,893,525, entitled "Refiner Plate with Variable Pitch", the disclosure of which is hereby incorporated by reference. In a variation, the primary refiner has a directional rotor plate (model 36604, available from Andritz Inc., Muncy, Pa.) and the variable pitch stator plate, with the secondary refiner having the variable pitch plate pattern on both the stator and rotor. Results are shown in Table II:

TABLE II

PULP QUALITY COMPARISON
D14B002 VERSUS 36604/36SA001 IN PRIMARY STAGE

| PRIMARY PLATES<br>SECONDARY PLATES | D14B002 R/S<br>36SA001 R/S | 36604R/36SA001S<br>36SA001 R/S | |
|---|---|---|---|
| Primary Pressure (psi) | 85 | 85 | 85 |
| Primary Speed (rpm) | 2600 | 2600 | 2600 |
| Secondary Pressure | 70 | 70 | 70 |
| Secondary Speed | 2300 | 2300 | 2300 |
| Freeness (ml) | 323 | 307 | 343 |
| Specific Energy kWh/MT | 998 | 1264 | 1245 |
| Bulk | 2.98 | 2.82 | 2.85 |
| Burst Index | 1.5 | 1.9 | 1.8 |
| Tear Index | 10.9 | 11.0 | 11.3 |
| Tensile Index | 27.9 | 35.7 | 34.8 |
| Stretch | 1.64 | 2.08 | 1.92 |
| TEA | 18.37 | 32.75 | 28.21 |
| Scattering Coefficient | 47.3 | 50.1 | 50.7 |
| Brightness (ISO) | 51.5 | 53.6 | 52.8 |
| Shive Content (%) | 0.92 | 0.16 | 0.22 |
| +28 Mesh (%) | 39.9 | 41.4 | 40.6 |
| −200 Mesh (%) | 27.8 | 22.6 | 27.3 |

The variable pitch pattern of the 36SA001 plate permitted higher levels of applied load and more stable refining compared to the more conventional bidirectional D14B002 pattern in the secondary refining stage. The configuration combining the 36604R/36SA001S (primary stage) and 36SA001R/S (secondary stage) provided higher overall strength properties and higher optical properties. The improved brightness with this configuration is likely due to better steam evacuation with the 36SA001 plate. Stable secondary refiner loading was successfully conducted from 700 kwh/t to over 1000 kwh/t.

Table III compares the effect of high speed/high pressure secondary refining versus standard conditions. In this testing, the primary pulps were completed at RTS conditions.

TABLE III

EFFECT OF HIGH SPEED/HIGH PRESSURE
SECOND STAGE REFINING OF PRIMARY RTS PULP

| PROCESS | RTS | RTS$^2$ | RTS$^2$ | RTS$^2$ | RTS | RTS$^2$ |
|---|---|---|---|---|---|---|
| Primary Speed | 2600 | 2600 | 2600 | 2600 | 2600 | 2600 |
| Primary Pressure | 85 | 85 | 85 | 85 | 85 | 85 |
| Primary Retention | 0.16 | 0.16 | 0.16 | 0.16 | 0.16 | 0.16 |
| Primary Pattern | | 36604R/SA001 | | | 36604R/SA001S | |
| Secondary Pressure | 40 | 70 | 70 | 70 | 40 | 70 |
| Secondary Speed | 1800 | 2300 | 2600 | 2600 | 1800 | 2300 |
| Secondary Pattern | 36SA001 | 36SA001 | 36SA001 | 36SA001 | 36SA001 | 36SA001 |
| Freeness (ml) | 330 | 333 | 307 | 343 | 175 | 164 |
| Bulk | 3.13 | 2.98 | 2.82 | 2.85 | 2.71 | 2.58 |
| Burst Index | 1.5 | 1.7 | 1.9 | 1.8 | 1.9 | 2.2 |
| Tear Index | 10.9 | 11.1 | 11.0 | 11.3 | 8.8 | 9.5 |
| Tensile Index | 31.1 | 32.7 | 35.7 | 34.8 | 35.6 | 40.9 |
| Stretch | 1.74 | 1.88 | 2.08 | 1.92 | 1.97 | 2.16 |
| TEA | 21.65 | 25.40 | 32.75 | 28.21 | 29.12 | 36.25 |
| Opacity | 91.5 | 92.6 | 94.4 | 93.3 | 94.9 | 94.2 |
| Scattering Coefficient | 46.5 | 48.0 | 50.1 | 50.7 | 57.0 | 52.1 |
| Brightness (ISO) | 52.6 | 52.9 | 53.6 | 52.8 | 51.6 | 52.5 |
| Shive Content (%) | 0.36 | 0.36 | 0.16 | 0.22 | 0.16 | 0.08 |
| +28 Mesh(%) | 45.9 | 41.7 | 41.4 | 40.6 | 33.2 | 34.7 |
| −200 Mesh(%) | 22.7 | 23.6 | 22.6 | 27.3 | 27.4 | 26.5 |
| Specific Energy | 1513 | 1330 | 1264 | 1245 | 1644 | 1470 |
| Energy Differential (kWh/MT) | — | 183 | 249 | 268 | — | 174 |

The RTS$^2$ pulps produced at high speed/high pressure in the secondary refining stage had improved overall strength properties and lower shive content than the control RTS pulps. The reduction in specific energy ranged from 174 kwh/t–183 kwh/t (at 2300 rpm) to 246–268 kwh/t (at 2600 rpm) compared to the control RTS pulps at a similar freeness.

Another series of tests were run using the directional rotor and the variable pitch stator, in both the primary and secondary refining positions. Table IV shows the results of these tests.

TABLE IV

COMPARISON OF TMP AND RTS$^2$ PROCESSES
INTERPOLATED AT 200 ML

| PROCESS | TMP | RTS$^2$ |
|---|---|---|
| Primary Speed (rpm) | 1800 | 2600 |
| Primary Pressure (psi) | 40 | 85 |
| Primary Retention (min) | 3.0 | 0.16 |
| Primary Pattern | 36604R/36SA001S | 36604R/36SA001S |
| Secondary Pressure (psi) | 40 | 70 |
| Secondary Speed (rpm) | 1800 | 2300 |
| Secondary Pattern | 36604R/36SA001S | 36604R/36SA001S |
| Freeness (ml) | 200 | 200 |
| Bulk (cm$^3$/g) | 2.69 | 2.72 |
| Burst Index | 2.1 | 2.2 |
| Tear Index | 10.1 | 10.2 |
| Tensile Index | 35.9 | 38.5 |
| Stretch | 1.90 | 1.98 |
| TEA | 30.8 | 32.6 |
| Opacity | 92.9 | 92.8 |
| Scattering Coefficient | 49.2 | 50.3 |

TABLE IV-continued

| COMPARISON OF TMP AND RTS² PROCESSES INTERPOLATED AT 200 ML | | |
|---|---|---|
| PROCESS | TMP | RTS² |
| ISO Brightness | 52.2 | 51.4 |
| Shive Content (%) | 0.18 | 0.12 |
| +28 Mesh (%) | 41.1 | 42.9 |
| −200 Mesh (%) | 21.3 | 17.5 |
| Specific Energy (kWh/MT) | 1766 | 1348 |
| Energy Savings (kWh/MT) | — | 418 |

Larger quantities of primary pulp were produced and blended to permit 3–4 secondary runs each at a different level of specific energy. This permitted establishment of differences in specific energy requirements between the TMP and RTS² processes. Table IV compares the two processes interpolated at a freeness of 200 ml. The RTS² pulps had a reduction in specific energy requirements of 418 kwh/t compared to the TMP at a similar freeness level. The strength properties and scattering co-efficient of the RTS² pulp was higher. The brightness was approximately 0.8 ISO lower. This may be a result of a laboratory limitation of the feed system being designed for wood chips, rather than primary pulp. In actual operation with the direct blow secondary refiner (as shown in FIG. 1), the brightness of the RTS² pulps would be expected to be higher due to the lower residence time between the refiner plates (i.e, as observed in RTS operation).

FIGS. 4–14 illustrate a comparison of the RTS² and TMP pulp quality results with RTS² refiner plate configuration of Table IV.

Figure 2:
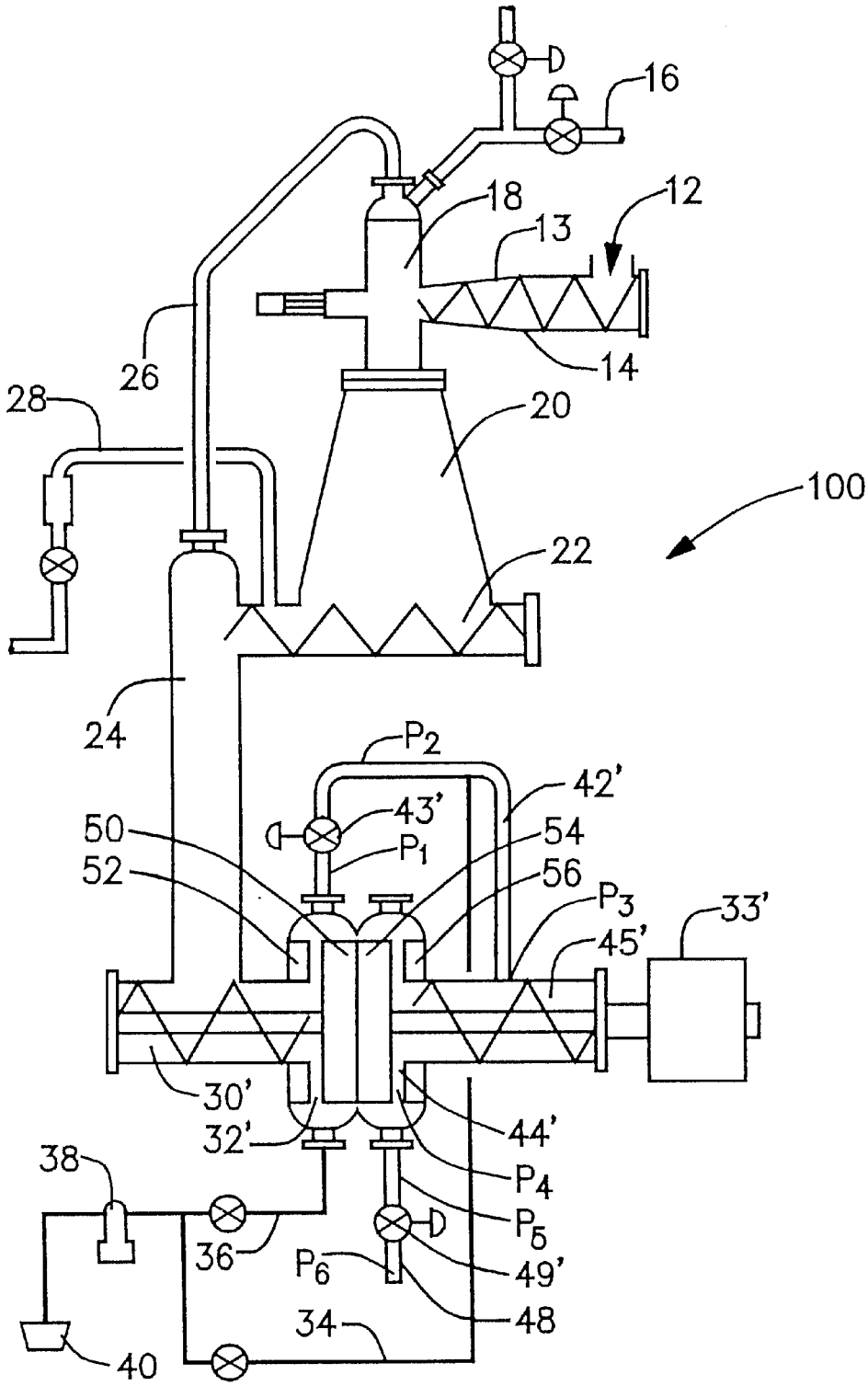
FIG. 2 is a system representation of a second embodiment of the invention, wherein the primary and secondary refining zones are situated within a single refining machine.

FIG. 2 illustrates a second embodiment of the RTS² system 100, wherein the components having like numeric identifiers perform like functions, relative to the embodiment shown and described in FIG. 1. In addition, numeric identifiers with primes (') indicates structure with similar functionality, and structure not previously described with respect to FIG. 1, carries altogether new numeric identifiers.

In the second embodiment 100, the preheat treatment is identical to that described with respect to the embodiment of FIG. 1, in that the preheated material enters refiner feed mechanism 30' where the helical ribbon quickly delivers the material into the refiner casing. In this embodiment, the casing encapsulates primary and secondary refiners, represented by primary refining zone 32' and secondary refining zone 44'. These zones are defined by a central rotor having primary and secondary sides 50, 54 with rotor plates rotated by a common drive motor 33'. A primary stator 52 with associated plate is spaced from the surface of primary rotor plate 50 to define the primary refining zone 32' therebetween. The casing is so formed, or else divider structure is positioned, such that the material which undergoes primary refining in zone 32' does not pass directly into the secondary refining zone 44', but rather is discharged through valve 43' into blow line 42' for introduction into the feed mechanism 45' of the secondary refining stage. This would also typically be a helical ribbon rotated, along with the primary feed ribbon 30, by motor 33'. The partially refined material is conveyed by feed mechanism 45' for introduction into the secondary refining zone 44', situated between secondary rotor plate 54 and an associated secondary stator with plate 56. The completely refined material is then discharged through blow line 48' for further processing in accordance with conventional practice.

It should be appreciated that the pressure differential across valve 43' in blow line 42', is established by the difference in refining pressure in primary zone 32' versus secondary zone 44'. It should be understood, however, that as is well known in the relevant field of technology, the pressure profile between the rotor and stator defining each of the zones, is not necessarily uniform, due to the generation of steam during the refining of the material.

As an implementing example of the embodiment of the invention represented in FIG. 2, six points are identified at P1, P2, . . . P6. The pressure at P1 can be in the range of 75–95 psi; the pressures at P2, P3, P4, and P5 in the range of 60–85 psi; and the pressure at P6 less than 60 psi.

Figure 3:
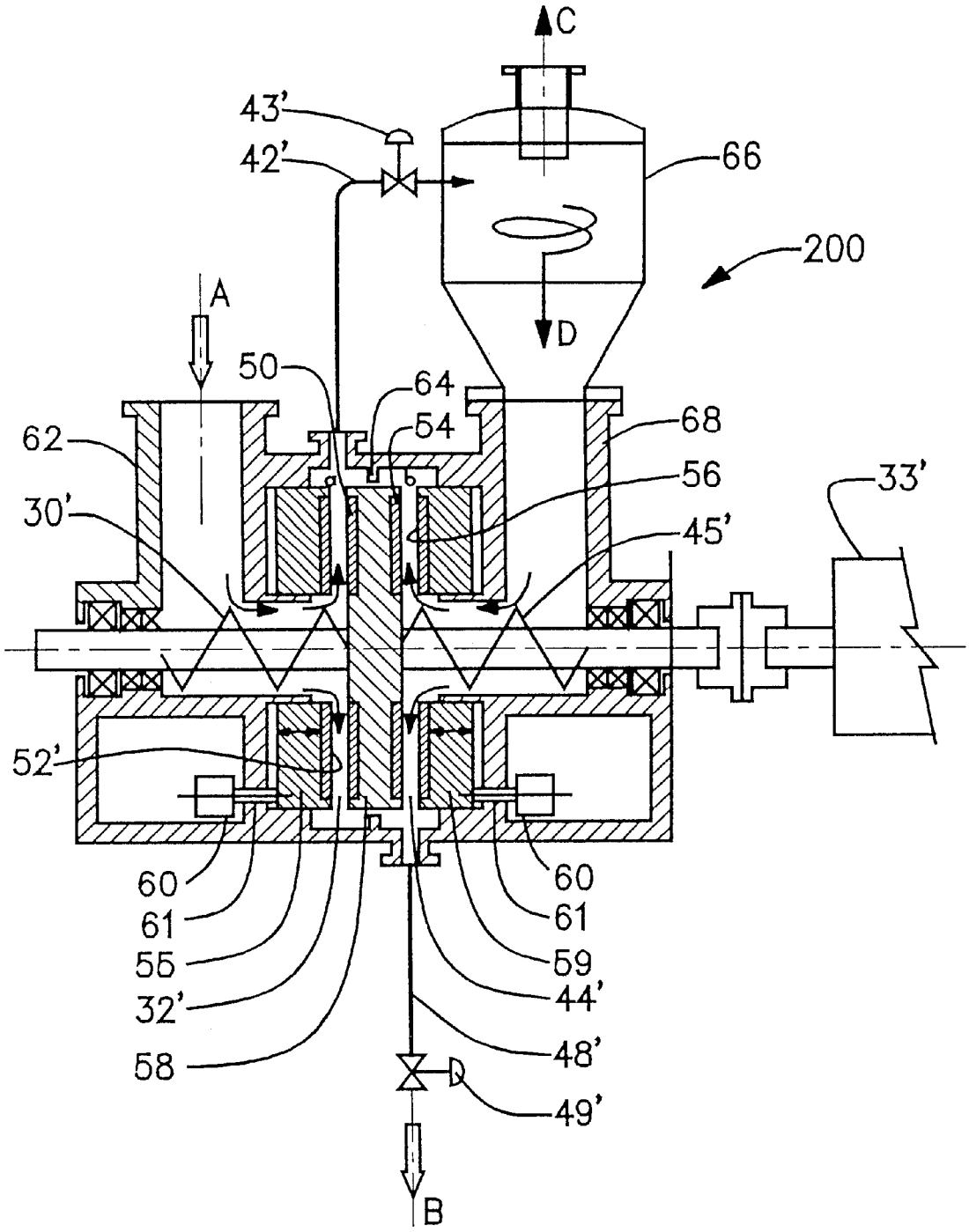
FIG. 3 is a schematic representation of an alternative refining machine for use in the embodiment of FIG. 2, wherein a steam separator is situated between the discharge of the primary refining zone and the feed mechanism for the secondary refining zone.
Figure 4:
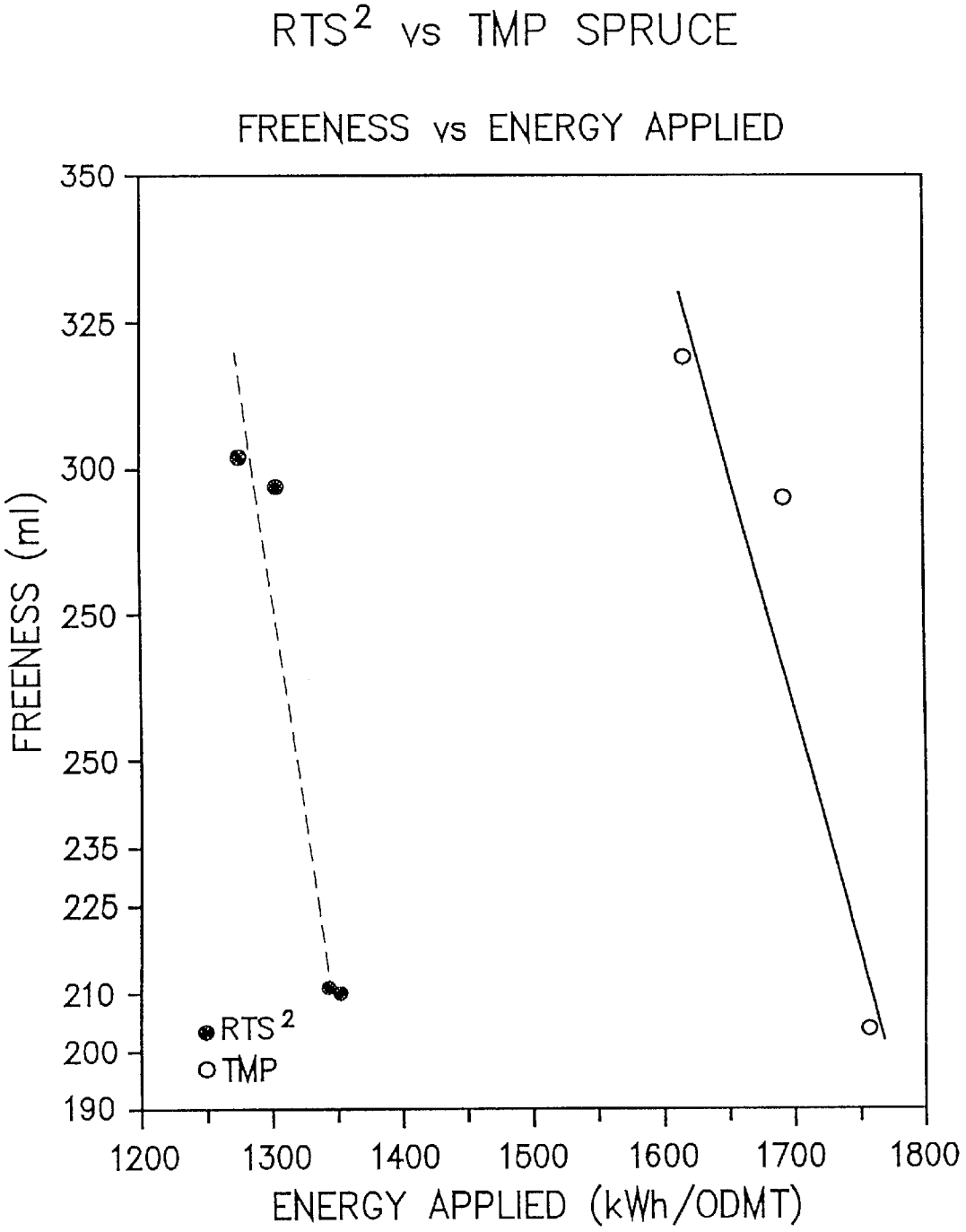
FIG. 4 is a graphic comparison of freeness versus energy applied, according to the invention as compared with conventional TMP.
Figure 5:
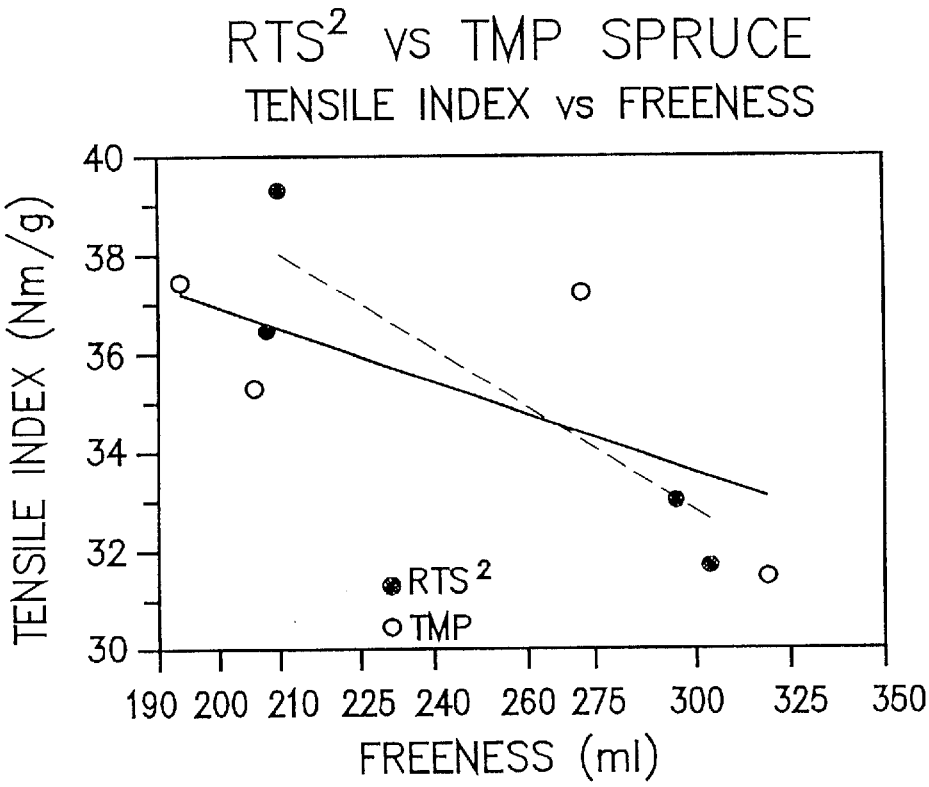
FIGS. 5 & 6 are graphic comparisons of the tensile index versus freeness and versus energy applied, respectively, for the present invention as compared with conventional TMP.
Figure 6:
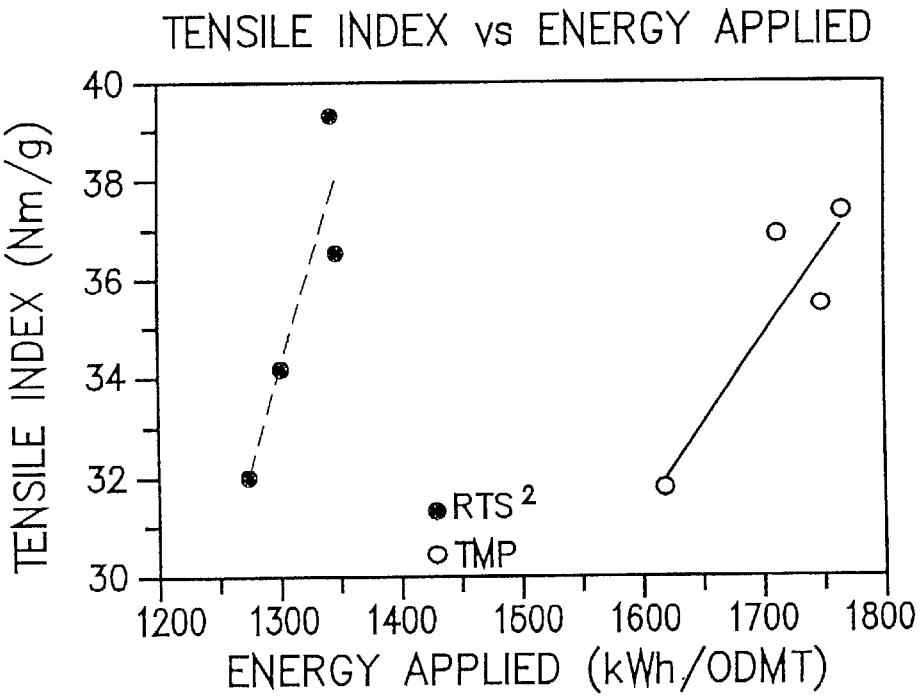
Figure 7:
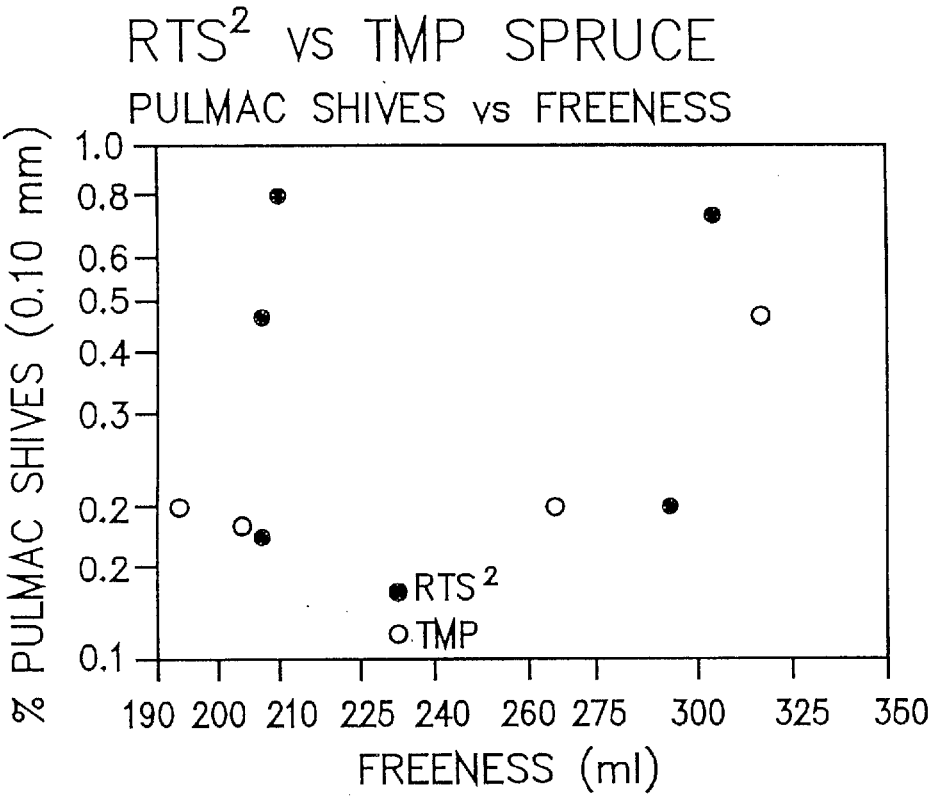
FIGS. 7 & 8 are graphic comparisons of the shive content versus freeness and versus energy applied, respectively, for the present invention as compared with conventional TMP.
Figure 8:
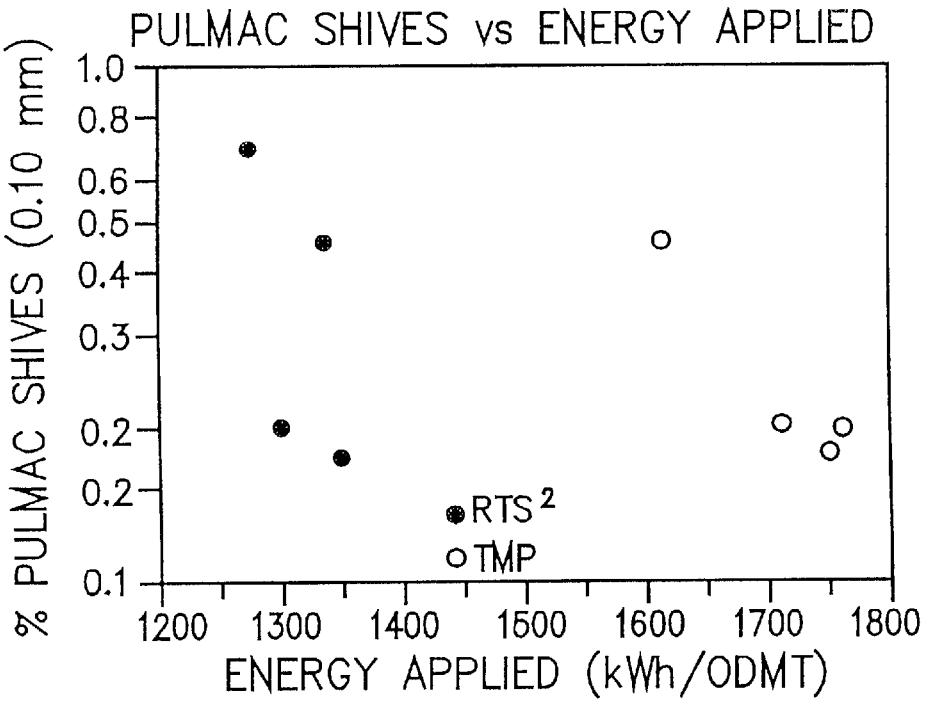
Figure 9:
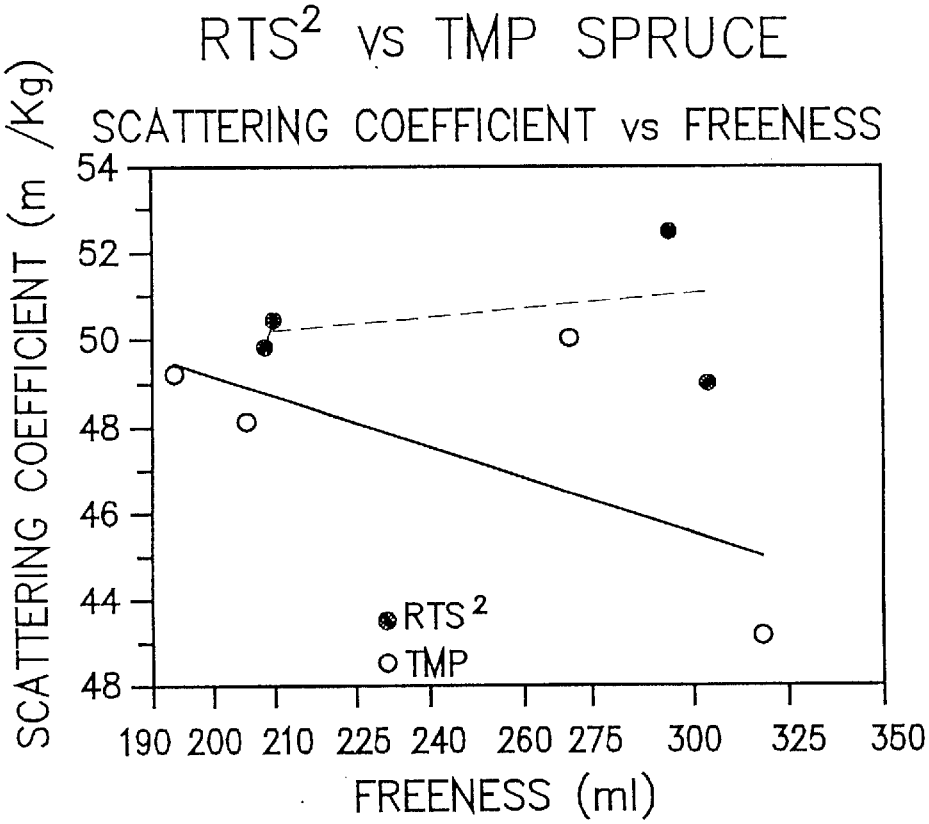
FIGS. 9 & 10 are graphic comparisons of the scattering co-efficient versus freeness and versus energy applied, respectively, for the present invention as compared with conventional TMP.
Figure 10:
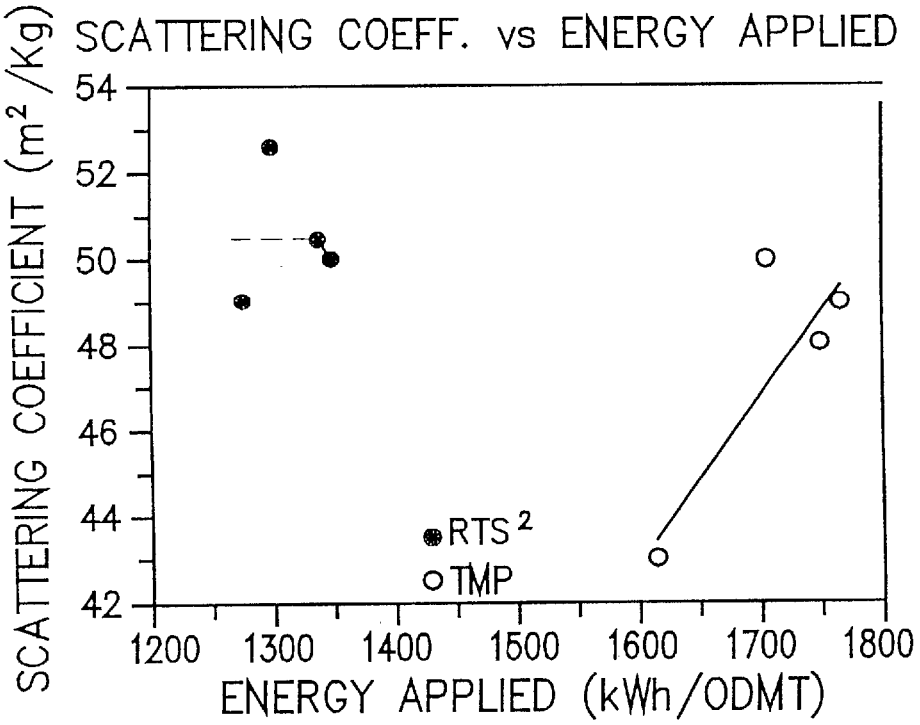
Figure 11:
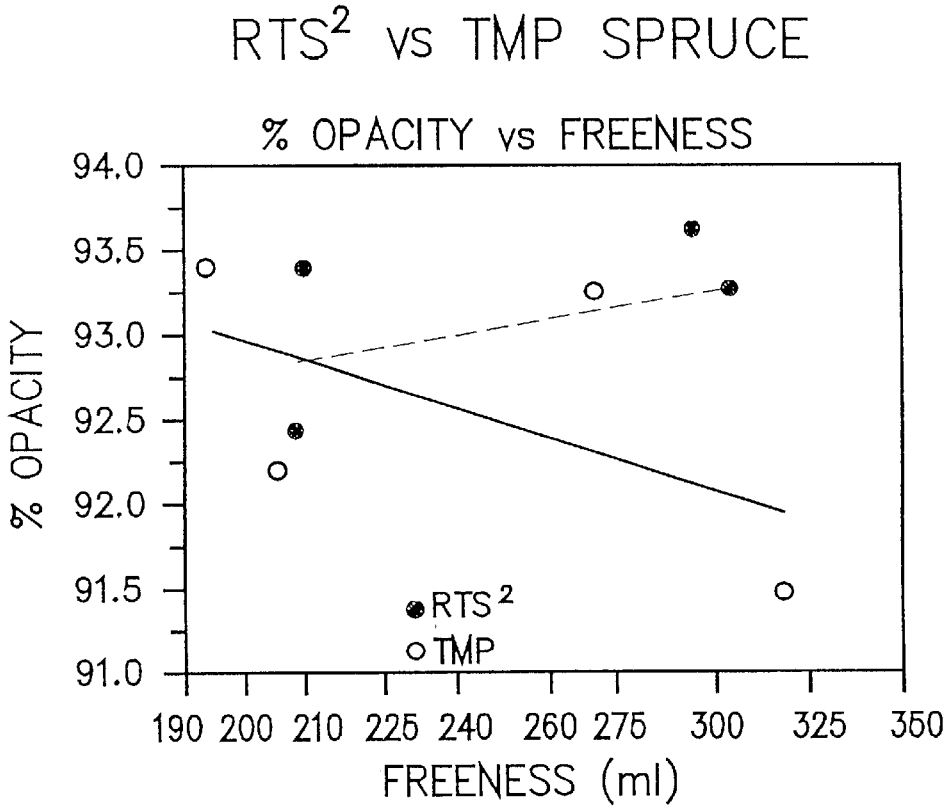
FIGS. 11 & 12 are graphic comparisons of opacity versus freeness and versus energy applied, respectively, for the present invention as compared with conventional TMP.
Figure 12:
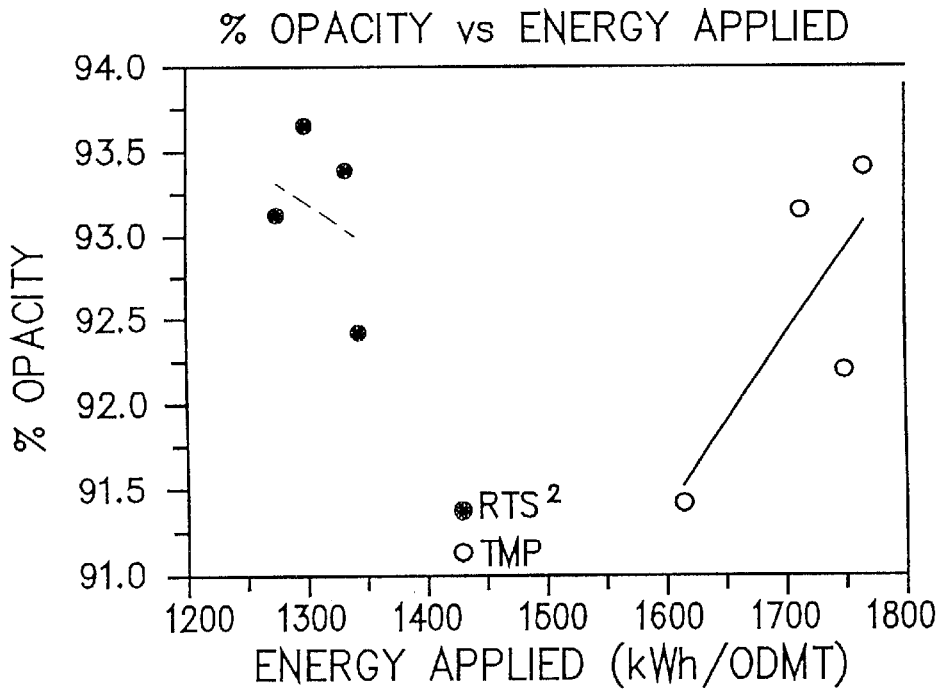
Figure 13:
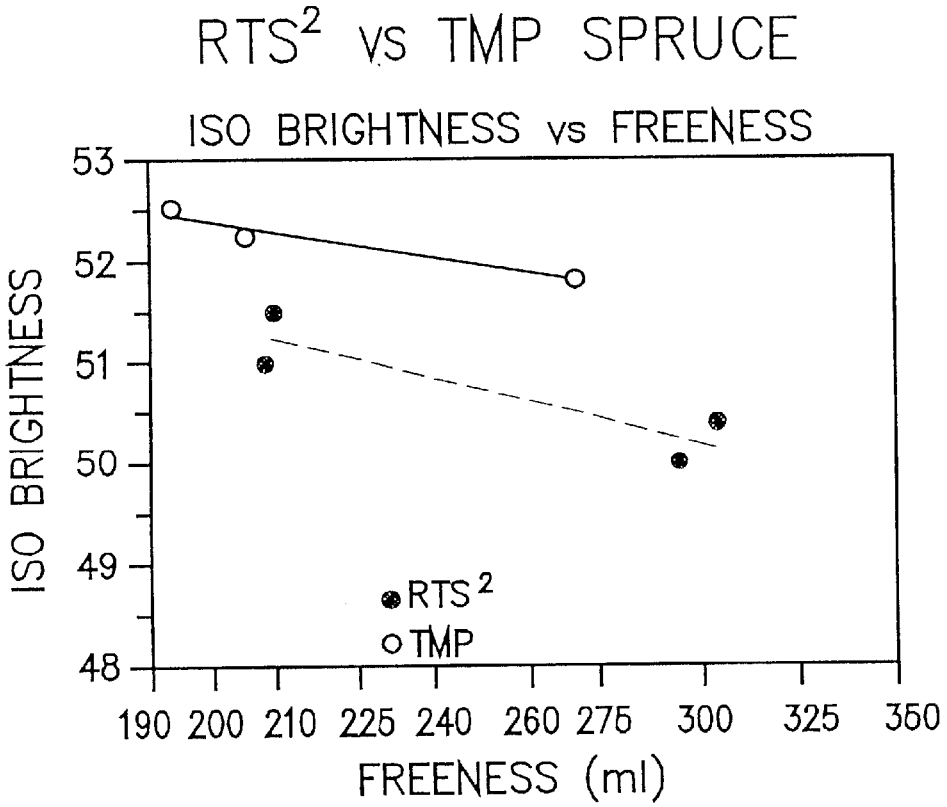
FIGS. 13 and 14 are graphic comparisons of the brightness versus freeness and versus energy applied, respectively, for the present invention as compared with conventional TMP.
Figure 14:
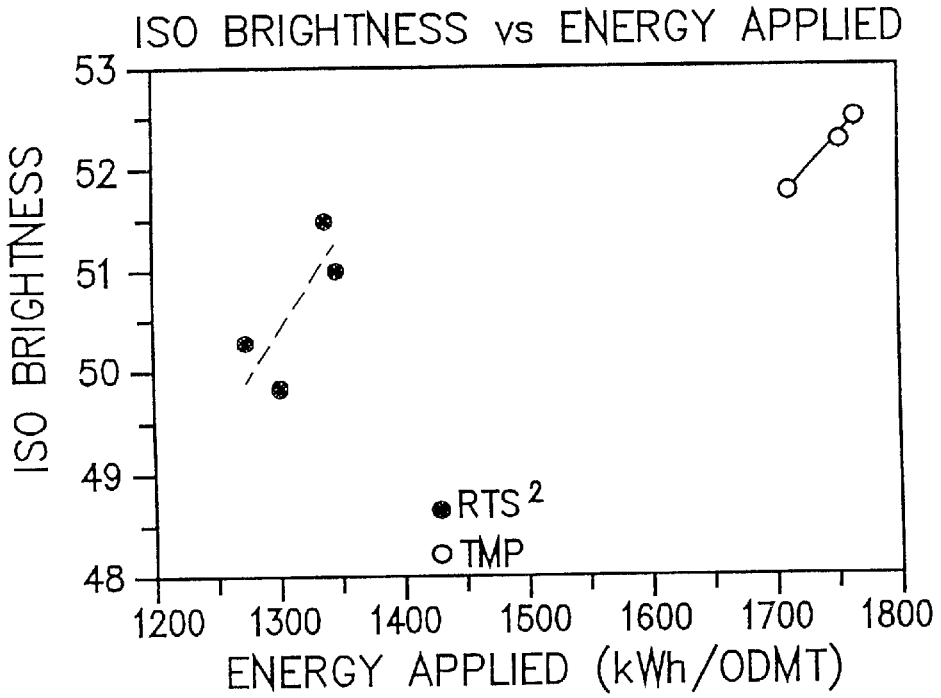

FIG. 3 represents a variation 200 of the embodiment shown in FIG. 2, whereby the discharge from the primary refining zone 32' through line 42', is blown to a cyclone 66 to separate a portion of the steam from the fiber. Steam is extracted via direction C and the partially refined pulp material is propelled downwardly along direction of arrow D. FIG. 3 also shows schematically, some additional details that were described but not explicitly shown in FIG. 2.

Preheated chip material enters the primary side along the direction of arrow A through inlet fitting 62 for conveyance via primary refiner feed mechanism 30' into primary refining zone 32'. That zone is defined between the rotor disc 58 which carries primary plates 50 on one side, in juxtaposition with stator 55, which carries primary stator plates 52. The partially refined pulp accumulates in plenum a and is discharged through blow line 42' under the control of control valve 43', for introduction into the steam separator 66. The primary pulp travels in the direction D into the secondary inlet fitting 68 for introduction into the secondary feed mechanism 45'. The material then passes through secondary refining zone 44' defined between secondary rotor plates 54 and secondary stator plates 56 carried on stator 55'.

As is conventional, the primary stator 55 may be adjusted axially by means of control motor or hydraulic piston assembly with shaft 60, 61. A seal or similar restrictive structure 64 prevents material from passing from plenum a directly to plenum b. Rather, the fully refined pulp in plenum b is discharged through blow line 48, subject to control valve 49'.

One of the major advantages of the present invention is that with use of RTS in the primary refining, the fiber temperature has been increased well above that of conventional primary TMP. This represents a high level of thermal softening prior to secondary refining. The initial high temperature in the primary stage is achieved with selective heat shocking in chip form to prevent brightness loss. Whereas the chip/fiber temperature is above $T_g$, the temperature of the lignin preferably remains below $T_g$. This benefit carries through in preparation for second stage refining at high disc speed, i.e., high speed can be utilized without fiber damage. Moreover, the high RTS fiber temperature, permits operation of the secondary stage if desired, at or even below the temperature of the primary stage.

It may thus be appreciated that in one broad aspect, the invention is directed to a method of producing mechanically refined pulp from feed material containing lignocellulose fiber, whereby the feed material is preheated at a temperature above the glass transition temperature ($T_g$) and then immediately introduced into a high-consistency primary refining zone between relatively rotating discs in which the relative speed of disc rotation is at least 2000 rpm and the temperature in the primary refining zone remains above $T_g$. The partially refined pulp is discharged from the primary refining zone and introduced into another high consistency, secondary refining zone between relatively rotating discs in which the relative speed of disc rotation is at least 2000 rpm and the temperature of the secondary refining zone remains above $T_g$, thereby producing mechanically refined pulp. The saturation pressure associated with the primary preheating and refining, and the secondary preheating and refining, will be above 65 psi.

In particular, the pressure $T_1$ associated with the primary conditions will typically be above 75 psi, and preferably in the range of 80–90 psi. The pressure $T_2$ associated with the secondary conditions will preferably be in the range of 70–80 psi, but it should be appreciated that the primary pressure and secondary pressure can be the same. The lower secondary pressure conditions, e.g., below 75 psi, would likely be encountered in the implementation of $RTS^2$ where both refining zones are contained within a single machine. In an implementation whereby the primary and secondary refining are performed on either side of a single rotating disc, it is likely that the secondary pressure conditions will be less than the primary conditions, by up to about 15 psi.

The residence time of the material $R_1$ fed into the primary refiner, and the residence or travel time $R_2$ between the primary and secondary refiner, would typically be well under 30 seconds each, i.e., under 20 seconds and preferably under about 15 seconds each. Excellent results were achieved in the RTS process with primary preheat times $R_1$ of 5–15 seconds. The optimal time interval for $R_2$ should be less than $R_1$ in the $RTS^2$ invention. The most effective implementation of the $RTS^2$ invention, appears to be achievable with the preheat residence time $R_1$ in the range of 5–15 seconds, and the secondary preheat residence or travel time $R_2$ being in the range of about 1–5 seconds.

The primary disc rotation speed for a single disc refiner, is preferably $S_1$=2300–2600 rpm, and likewise for a single rotating disc secondary refiner, the preferable range is $S_2$ =2300–2600 rpm, although as higher speed capabilities are developed in the future, the preferred high speeds may very well climb above 2600 rpm. For double disc refiners used either as the primary or secondary refiner, the preferred speed range is 1800–2300 rpm for both $S_1$, and $S_2$, again subject to future developments in high speed technology. Of course, the present invention can be implemented with the primary and secondary refiners being of different design, i.e., the primary or secondary being a single disc refiner and the secondary or primary being a double disc refiner, respectively. In any of these variations, the speed $S_2$ need not be the same as speed $S_1$, although if they are different, $S_2$ will likely be lower than $S_1$.

In general, the conditions for secondary refining in the $RTS^2$, include high secondary pressure and high secondary disc rotation speed, with the material remaining above $T_g$ throughout its travel from the primary preheating until discharged from the secondary refining zone. Nevertheless, the $RTS^2$ process shows significant improvement relative to both RTS and conventional TMP, if the secondary pressure conditions $T_2$ are higher than the pressure in conventional TMP refiners. Whereas conventional refiners are typically operated below 60 psi, the secondary pressure in the $RTS^2$ process according to the invention, will in any event be at least about 65 psi. Based on the experimental investigation to date, the ideal results are obtained when the plate patterns (of bars and grooves) in the secondary refining zone are different from those in the primary refining zone. The secondary refiner plates at $RTS^2$ conditions should be designed to maintain a stable pulp pad between the refiner plates when operating at the high disc speed.

What is claimed is:

1. A method of producing mechanically refined pulp from feed material containing lignocellulose fiber, comprising:

preheating the feed material at a temperature above the glass transition temperature ($T_g$) of the lignin in the feed material;

immediately introducing the preheated feed material into a high consistency primary refining zone between relatively rotating discs in which the relative speed of disc rotation is greater than 1800 rpm and the temperature in the primary refining zone remains above $T_g$, thereby producing partially refined pulp;

discharging the partially refined pulp from the primary refining zone;

introducing said partially refined pulp into a high consistency secondary refining zone between relatively rotating discs in which the relative speed of disc rotation is greater than 1800 rpm and the temperature of the secondary refining zone remains above $T_g$, thereby producing said mechanically refined pulp;

wherein the preheat temperature, primary refining temperature, and secondary refining temperature correspond to steam saturation pressure above about 65 psig; and wherein the feed material is preheated at a temperature above $T_g$ for less than about 15 seconds and the partially refined pulp is maintained at a temperature above $T_g$ for less than about 15 seconds while between the primary refining zone and the secondary refining zone.

2. The method of claim 1, wherein the relative speed of disc rotation in the primary refining zone is the same as the relative speed of disc rotation in the secondary refining zone.

3. The method of claim 2, wherein the primary refining zone is on one side of a rotating disc and the secondary refining zone is on the other side of the same rotating disc.

4. The method of claim 1, wherein the feed material is preheated in an environment of saturated steam at a preheat saturation temperature and the preheated material is then refined in the primary refining zone in an environment of saturated steam which is at substantially the same saturation temperature as the preheat saturation temperature.

5. The method of claim 1, wherein the partially refined pulp is discharged from the primary refining zone with steam, and some of said discharged steam is separated from the partially refined pulp before the partially refined pulp is introduced into the secondary refining zone.

6. The method of claim 5, wherein the partially refined pulp discharged from the primary refining zone remains above $T_g$ until the secondary refining is completed.

7. The method of claim 1, wherein the partially refined pulp discharged from the primary refining zone remains above $T_g$ until the secondary refining is completed.

8. The method of claim 1, wherein the relative speed of disc rotation in the primary and secondary zones is at least 2000 rpm.

9. The method of claim 8, wherein the feed material is preheated in an environment of saturated steam at a preheat saturation pressure above about 80 psi, the preheated material is then refined in the primary refining zone in an environment of saturated steam which is at substantially the same saturation temperature as the preheat saturation temperature.

10. The method of claim 1, wherein the relative speed of disc rotation in the primary and secondary zones is at least 2300 rpm.

11. A method of producing mechanically refined pulp from feed material containing lignocellulose fiber, comprising:

preheating the feed material in an environment of saturated steam at a pressure of at least 75 psig at a temperature above the glass transition temperature ($T_g$) of the lignin in the feed material for a preheat time interval of less than about 15 seconds;

immediately introducing the preheated feed material into a high consistency primary refining zone between relatively rotating discs in which the relative speed of disc rotation is at least 2000 rpm and the temperature in the primary refining zone remains above $T_g$, thereby producing partially refined pulp;

discharging the partially refined pulp from the primary refining zone;

within about 15 seconds, introducing said partially refined pulp into a high consistency secondary refining zone between relatively rotating discs in which the relative speed of disc rotation is at least 2000 rpm and the secondary refining zone pressure is at least 65 psig, thereby producing said mechanically refined pulp.

12. The method of claim 11, wherein the relative speed of disc rotation in the primary refining zone is the same as the relative speed of disc rotation in the secondary refining zone.

13. The method of claim 12, wherein the primary refining zone is on one side of a rotating disc and the secondary refining zone is on the other side of the same rotating disc.

14. The method of claim 11, wherein the feed material is preheated at a pressure in the range of 80–90 psig;

the primary refining zone is between a stator disc and a rotor disc rotating at least 2300 rpm;

the partially refined pulp has a secondary preheat travel time from the primary refining zone to the secondary refining zone of less than about 10 seconds while at a saturation pressure in the range of about 70–80 psig.

15. The method of claim 14, wherein the disc rotation speed in the primary refiner zone is at least 2600 rpm and the disc rotation speed in the secondary refining zone is at least 2300 rpm.

16. The method of claim 15, wherein the material remains above $T_g$ from said preheating until discharged from the secondary refining zone.

17. The method of claim 16, wherein the preheat time interval is less than about 10 seconds and the secondary preheat travel time is less than about 10 seconds.

18. The method of claim 14, wherein the material remains above $T_g$ from /said preheating until discharged from the secondary refining zone.

19. The method of claim 14, wherein the preheat time interval is less than about 10 seconds and the secondary preheat travel time is less than about 10 seconds.

20. The method of claim 11, wherein the secondary preheat travel time is less than the preheat time interval.

* * * * *